US005921045A

United States Patent [19]

Hickey et al.

[11] Patent Number: 5,921,045

[45] Date of Patent: Jul. 13, 1999

[54] TILE ROOF CONSTRUCTION

[75] Inventors: Michael J. Hickey, Irvine; James E. Lee, Fountain Valley; Robert Ward, Signal Hill, all of Calif.

[73] Assignee: Newport Fastener Company, Anaheim, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/748,006

[22] Filed: Nov. 12, 1996

Related U.S. Application Data

[63] Continuation of application No. 08/409,172, Mar. 23, 1995, abandoned.

[51] Int. Cl.[6] ..... E04D 1/34

[52] U.S. Cl. ..... 52/543; 52/547; 52/549; 52/551; 52/713

[58] Field of Search ..... 52/543, 544, 546, 52/547, 549, 551, 552, 554, 713

[56] References Cited

U.S. PATENT DOCUMENTS

| | | | |
|---|---|---|---|
| 978,334 | 12/1910 | Overbury | 52/551 |
| 1,523,472 | 1/1925 | Bobbitt . | |
| 1,574,099 | 2/1926 | Kridler . | |
| 1,952,317 | 3/1934 | Holder | 52/551 |
| 2,025,983 | 12/1935 | Harrington . | |
| 2,057,819 | 10/1936 | Corcoran et al. | 52/551 X |
| 2,084,609 | 6/1937 | Corcoran . | |
| 2,152,080 | 3/1939 | Munsey . | |
| 2,475,795 | 7/1949 | Lockwood | 52/547 X |
| 4,426,823 | 1/1984 | Kobe | 52/551 X |
| 5,079,889 | 1/1992 | Wright | 52/547 |

FOREIGN PATENT DOCUMENTS

| | | | |
|---|---|---|---|
| 150179 | 7/1937 | Australia . | |
| 43991 | 9/1934 | France | 52/547 |
| 355922 | 9/1961 | Switzerland | 52/547 |

OTHER PUBLICATIONS

The Advantages and Exclusive Features of Riness Tile Tie, by San Valle Tile Kilns, Tile Tie Systems, 1967.

Tyle–Tie, Tile Roofs, Tile Tie Systems, 1967.

Patent Application of W. McMurray for Roof Tile Anchoring System (1969).

Patent Application of W. McMurray for Tile Tie (1973).

Tile Roof Fastening Methods, by Newport Fastener, 1994, pp. 1–8.

"A Tile Roof is One Roof That Doesn't Have to be Nailed On" flyer by Tyle–Tye (Before 1975).

Tyle–Lok . . . A Way to Make Any Tile Roof Even More Secure, flyer distributed by San Valle Tile Kilns (Before 1975).

Roofs of Tile flyer by Riness Tile Tie Company (Before 1940).

Not One Leak Has Ever Occured ona Roof Using Tyle–Tye flyer by Tyle–Tye (Before 1947).

Tuix System, Modular system for the fixing and ventilation of the bent tiles brochure by Fornace Olivi Mission Tile & One Piece Mission Tile, 1969.

"Nail–Lok" flyer distributed by San Valle Tile Kilns (Before 1976).

Roofs of Tile, by Tile Tie Systems.

"Tyle–Tye and Riness Tyle–Tye Systems" brochure, distributed by San Valle Tile Kilns (Before 1975).

"A Tile Roof Is One Roof that Should Not Be Nailed to the Under Roofing" flyer by Tyle–Tye (Before 1975).

Riness Tile Tie, "The Tie That Binds" brochure by Gillis & Ellis (Before 1975).

*Primary Examiner*—Carl D. Friedman
*Assistant Examiner*—Timothy B. Kang
*Attorney, Agent, or Firm*—Price Gess & Ubell

[57] ABSTRACT

A two-part fastening mechanism employing (1) a continuous metal strip having attachment slots whose axes are oriented parallel to the length of the strip, and (2) a single preformed metal connector piece having a longitudinally-oriented hook for gripping one end of a tile and a stem portion insertable into one of the slots in the metal fastening strip and bendable over the slot and back upon itself for retaining the connector piece attached to the continuous metal strip. When installed, the fastening mechanism holds each tile in two places: at a first end via the hook, and at an opening in the tile where the connector piece passes through.

24 Claims, 2 Drawing Sheets

35
31
d
θ
21
201
19
27
17
11
25
23
15
13
L
27
24
29
47
39
41
36
35
44
28
35
36

TILE ROOF CONSTRUCTION

This is a continuation of application Ser. No. 08/409,172, filed Mar. 23, 1995, now abandoned.

BACKGROUND OF THE INVENTION

1. Field of the Invention

The subject invention relates generally to tile roof construction and more particularly to a tile roof construction employing a continuous metal strip and intermitting tile-retaining connector pieces.

2. Description of Related Art

Concrete and clay tiles have been used as a roof covering dating back to ancient Grecian times. A tile roof is fireproof, weatherproof, and an excellent insulating medium and, when laid properly, will last indefinitely. Properly installed, a tile roof can last a lifetime without breaking loose during high winds or earthquakes while, at the same time, protecting the waterproof membrane underneath. Today, roofing tiles come in a variety of shapes and sizes and are manufactured from either traditional clay or concrete.

Modern conditions have caused tile manufacturers, public safety commissions, building departments, as well as architects and engineers to demand greater security in roof tile installations, as well as in all phases of the building arts which affect public safety. Thus, it has proved desirable to securely fasten each roofing tile to the roof deck. Any such fastening system must take into account the considerable weight and varying dimensions of roofing tiles. One piece of clay or concrete roofing tile weighs between 5 and 10 pounds per tile. Each tile type is different and tile dimensions often vary from manufacturer to manufacturer.

Modern tile fastening systems typically employ tie wire networks for attaching the tile to the roof. The tie wire is conventionally 0.062-inch-diameter soft temper tie wire. One such system has employed a sheared extruded metal strip providing fastening loops of a semicircular section and profile oriented such that the axes of the loops are parallel to one another and perpendicular to the length of the strip. Tiles are tied to the loops by such wire which must be soft temper tie wire, which is manually twisted several times during installation. For extra holding power, so-called Wind Locks and/or Hurricane Clips have been used in conjunction with the fastening system. Despite advantages of such systems, installation is still relatively complex and expensive.

SUMMARY OF THE INVENTION

It is therefore an object of the invention to improve roof tile fastening systems;

It is another object of the invention to provide a roof tile fastening system which is capable of holding tiles in place in the face of high winds, while still exhibiting the flexibility required to withstand earthquakes; and It is another object of the invention to provide such a system which is much simpler and quicker to install than prior art systems.

These and other objects and advantages are provided according to the invention by a two-part fastening mechanism employing (1) a continuous metal strip having attachment slots whose axes are oriented parallel to the length of the strip, and (2) a single preformed metal connector piece having a longitudinally-oriented hook for gripping one end of a tile and a stem portion insertable into one of the slots in the metal fastening strip and bendable over itself for retaining the connector piece attached to the continuous metal strip. When installed, the fastening mechanism holds each tile in two places: at a first end via the hook, and at an opening in the tile where the connector piece passes through. The connector piece is preferably fabricated of material much thicker than prior art twisted tie wire, e.g., 0.090-inch (2.3 mm) in diameter and, according to the invention, is bent over by a single turn, avoiding the labor-intensive multiple twisting of the prior art. The system further has the advantages of a nonrigid system, thus being earthquake-resistant while providing extra holding power.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figures 1, 2, 3:
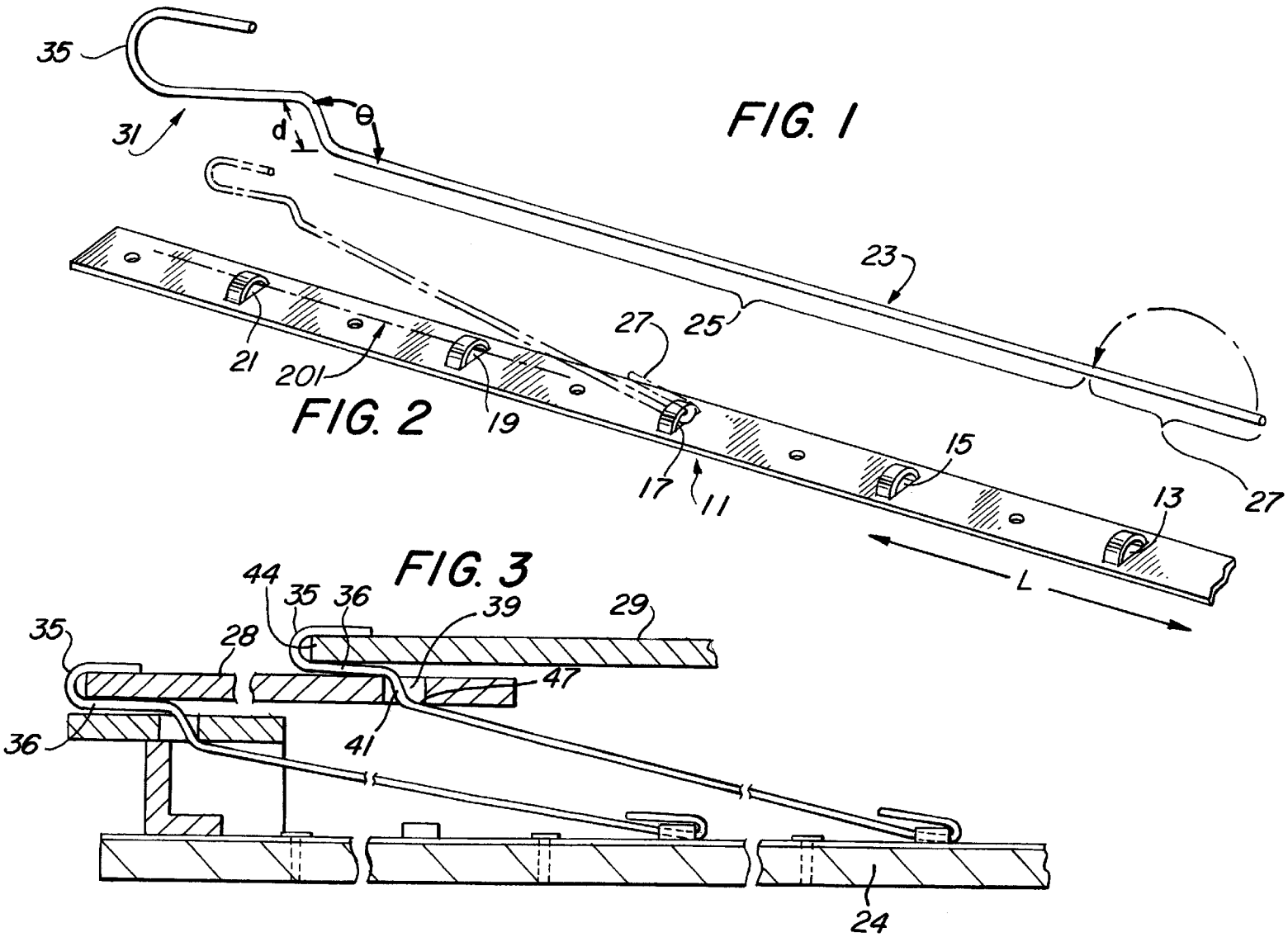
FIG. 1 is a perspective view of a connector piece according to the preferred embodiment of the invention.
FIG. 2 is a perspective view of a continuous metal strip according to the preferred embodiment.
FIG. 3 is a side sectional view illustrating installation of roofing tile according to the preferred embodiment.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a readily manufacturable and easily installed tile roof fastening system.

According to the preferred embodiment of FIGS. 1–4, a sheared extruded metal strip 11 is provided having a number of slots 13, 15, 17, 19, 21 formed therein. The slots 13, 15, 17, 19, 21 may have a semicircular section and profile in which case the centers of the semicircles may be disposed so as to lie on a common line 201 longitudinally extending through respective openings in the slots 13, 15, 17, 19, 21 parallel to the length "L" of the strip 11. The strip 11 is further preferably fabricated of Type 300 stainless steel and may be formed on reels and cut to length, a useful and preferred length being 10 feet. The strip 11 is preferably 1 inch (24.5 mm) wide and 0.029 inch (0.25 mm) thick. The strips 11 may be fastened to a roof 24 (FIGS. 3, 4) by conventional means such as stainless steel or FM ("Factory Mutual") approved noncorrosive screws, or coated roofing fasteners.

To retain associated roofing tiles, e.g., 28, 29 in place, an elongated connector piece 23 is provided, as shown in FIG. 1. The connector piece 23 has a rod-like central portion 25, which terminates in a stem or fastening portion 27, which may be bent over, as indicated in phantom in FIG. 2. At the opposite end 31 of the connector piece 23, the rod-like central portion 25 angles upward at an obtuse angle $\Theta_1$, which may be, for example, approximately 120 degrees for a distance "d." The rod 23 then turns 90 degrees into a horizontal, generally U-shaped hook 35. The distance "d" is preferably selected such that the angled portion 41 of length "d" passes through a hole 39 in a roofing tile 29 (FIG. 3), permitting one side 36 of the hook 35 to lie substantially parallel to the top face of tile 28. Thus, the connector piece 23 extends through the hole 39 in the roofing tile 29 such that the U-shaped hook 35 rests on the surface of the tile 28 and receives and retains the end 44 of the overlying tile 29. The connector piece 23 is preferably cold-formed of 0.090-diameter Type 300 stainless steel wire.

The connector piece 23, in combination with the slots 15, 17, 19, etc., provides extreme ease of assembly, by direct insertion of the stem 27 along the length "L" of the metal strip 11 in a direction parallel to the length "L" of the metal strip 11, while the U-shaped hook 35 provides secure retention of the tiles 28, 29. A particular tile 29 thus receives retaining or holding support at one end 44 and at the point 47 where the stem of the hook 35 engages the tile, e.g., adjacent the lower edge of the hole 39.

Figure 4:
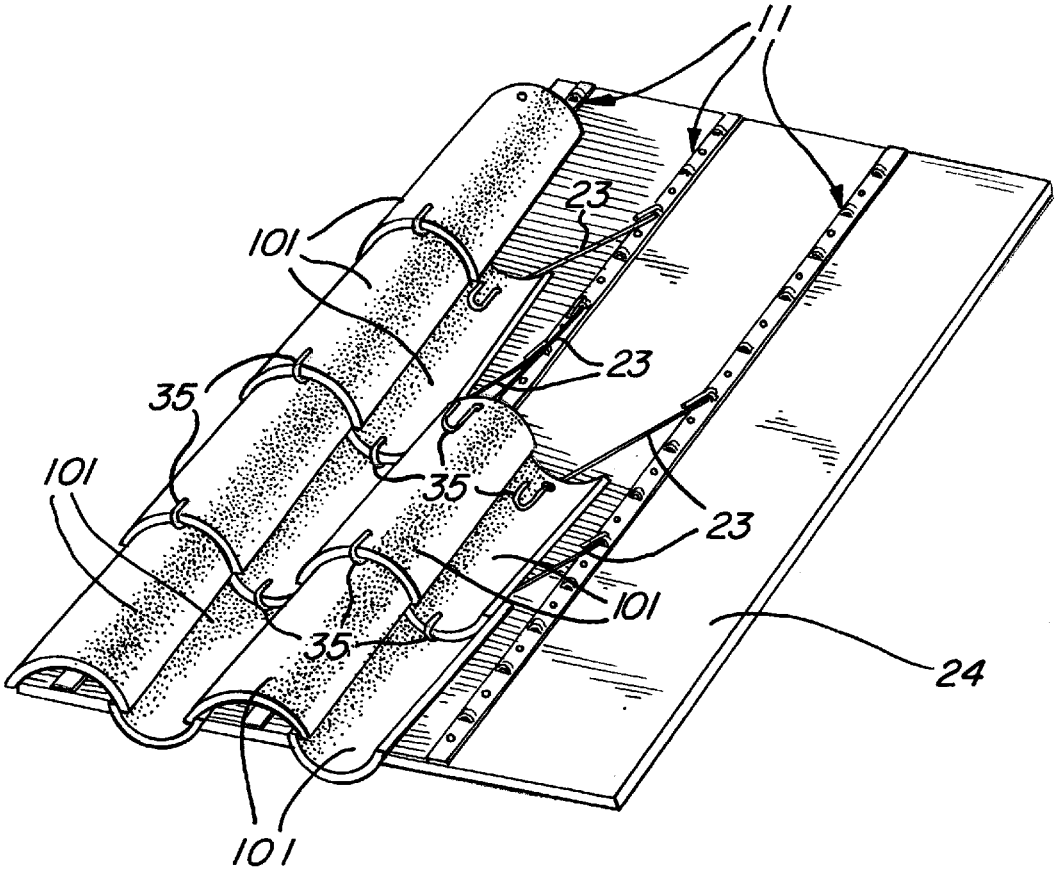
FIG. 4 is a perspective view further illustrating installation of roofing tile according to the preferred embodiment.

The application of the system of the preferred embodiment is further illustrated in FIG. 4 wherein a plurality of tiles 101 are fastened by a system comprising a plurality of strips 11 laid parallel to one another and attached to the tiles 101 by connector pieces 23 in the manner particularly illustrated in FIGS. 2 and 3.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A system for attaching roofing tiles to a roof, the system comprising:

a plurality of elongated metal strips arranged in parallel to one another on a roof, each strip having an edge, each edge having a length, the edges of each said strip lying parallel to one another;

a plurality of slots spaced apart from one another along the length of each of said strips, each slot having an opening therein;

a plurality of connector pieces, each formed of wire, each said connector piece having a preformed hook on one end extending through a hole in a cooperating roofing tile and hooking the end of a second said roofing tile, each connector piece further having a straight stem portion at the opposite end inserted through a respective opening of one of said slots and manually bent about the respective slot after insertion there through so as to form a second hook fastening said connector piece to said metal strip, said wire being of a type selected so that once said straight stem portion is manually bent to form said second hook, said second hook retains the respective second roofing tile in place on said roof; and wherein the opening in each said slot is oriented with respect to its respective strip such that a respective said straight stem portion lies parallel to the length of the respective strip.

2. The two-part roof tile fastening mechanism of claim 1, wherein each slot includes an opening with a center, each said center being oriented on a common line passing through said openings in said slots in a direction parallel to the length of the strip.

3. A two-part roof tile fastening mechanism for fastening a plurality of roof tiles, said two-part roof tile fastening mechanism comprising:

a continuous metal strip having a length and a plurality of attachment slots, each slot having an opening therein, each slot being spaced apart along the length of the strip;

a single preformed metal connector piece having a first hook gripping one end of a first of said roof tiles, and a linear rod portion terminating in a linear stem portion which passes through and is bent over one of said slots and back upon itself to form a second hook supporting at least the weight of said first of said roof tiles so as to retain said first of said roof tiles in place on a roof;

and wherein the opening in said one of said slots is oriented such that said linear stem portion lies along a direction parallel to the length of the strip.

4. The fastening mechanism of claim 3 wherein said connector piece is bent into a shape so as to extend through an opening in a second of said roof tiles, and to apply a retaining force at two places: at a first end of said first tile via the first hook means, and at the opening in the second roof tile where the connector piece passes through.

5. The fastening mechanism of claim 4 wherein said connector piece is fabricated of 0.090-inch-diameter wire.

6. The fastening mechanism of claim 5 wherein said wire is stainless steel.

7. The two-part roof tile fastening mechanism of claim 3, wherein each slot includes an opening with a center, each said center being oriented on a common line passing through said openings in said slots in a direction parallel to the length of the strip.

8. A roof tile structure for a roof comprising:

a plurality of roofing tiles;

a plurality of adjacent metal strips attached to said roof, each strip being disposed parallel to an adjacent strip;

a plurality of slots formed at intervals along each said strip; and a plurality of connector pieces, each formed of metal wire and each having a straight stem portion at a first end and a corresponding first hook at a second end, each first said hook grasping an end of a respective one of said roof tiles, the thickness and hardness of the metal wire selected so that the metal wire is manually bent back on itself in a single turn forming a second hook supporting at least the weight of one of said roof tiles, each said straight stem portion of each of said connector piece being inserted into a respective slot and manually bent around the respective slot to form said second hook while the corresponding first hook of each connector piece extends through a hole in a cooperating one of said tiles and rasps a respective said end, thereby holding said roof tiles in place against a selected dislodging force.

9. The system of claim 8 wherein each slot has an opening therein oriented with respect to said strip such that a respective said straight stem portion is directly inserted through said opening and lies in a direction parallel to the length of said strip.

10. The system of claim 8 wherein each said connector piece extends through a hole in the cooperating roofing tile and further is shaped to support said cooperating roofing tile at said hole.

11. The system of claim 8, wherein each slot includes an opening with a center, each said center being oriented on a common line passing through said openings in said slots in a direction parallel to the length of the strip.

12. A two-part fastening mechanism for roof tiles, said two-part mechanism comprising:

a continuous metal strip having a plurality of attachment slots, each slot having an opening with a center, each said center being oriented on a common line passing through said openings in said slots in a direction parallel to the length of the strip; and a single preformed metal connector piece having a longitudinally-oriented first hook means for gripping one end of a selected roof tile, and a linear rod portion terminating in a linear stem means for insertion into one of said slots, said rod and stem means being of a length, hardness and thickness selected so that said stem means is manually bendable back on itself in a single turn around the respective slot for forming a second hook means for supporting at least the weight of one of said roof tiles when said stem means is inserted into a said slot and said first hook means is gripping said one end.

13. The fastening mechanism of claim 12 wherein said connector piece, when hooked to grip the end of said tile, is shaped to extend through a hole in a cooperating roof tile so as to apply a retaining force at two places: at said one end via the first hook means, and at said hole where the connector piece passes through.

14. The fastening mechanism of claim 13 wherein said connector piece is fabricated of 0.090-inch-diameter wire.

15. The fastening mechanism of claim 14 wherein said wire is stainless steel.

16. A roof tile fastener attached to a slot of a cooperating metal strip consisting of:

a single preformed metal piece having a preformed longitudinally-oriented hook gripping one end of a roof tile, said longitudinally-oriented hook forming into a linear rod portion terminating in a linear stem portion inserted into one of said slots, said rod and stem portion being of a length, and type of material selected such that the stem portion is manually bent back on itself in a single turn so as to form a second hook supporting at least the weight of a roof tile after said stem portion is inserted through said slot and said longitudinally-oriented hook is in position gripping said one end of the roof tile.

17. A system for attaching roofing tiles to a roof comprising:

a plurality of metal strip means for disposal in parallel on a roof, a plurality of slots formed at intervals along each said strip means, each said slot including an opening with a center, each said center being oriented on a common line passing through said openings in said slots in a direction parallel to the length of the strip; and a plurality of connector piece means, each formed of bendable wire and having a straight stem portion means at one end and a hook means on the opposite end, each said straight stem portion means for insertion into a respective one of said slots and for manually bending about the respective slot to fasten said connector piece means to said strip means while said hook means is disposed to extend through a hole in a cooperating roofing tile and to hook the end of a second roofing tile, said stem portion means of each respective connector piece means further being of a material and thickness selected such that when bent about said slot means by a single turn, the respective connector piece means operates to hold said second roofing tile in place against a selected dislodging force.

18. The system of claim 17 wherein each slot has an opening therein oriented with respect to its respective strip means such that a respective said straight stem portion means is directly insertable through said opening by insertion along a path having a horizontal component generally parallel to the length of the respective strip means.

19. The system of claim 17 wherein said connector piece means further contacts and supports said cooperating roofing tile at said hole.

20. A two-part roof tile fastening mechanism for fastening roof tiles to a roof, the two-part fastening mechanism comprising:

a continuous metal strip having a plurality of attachment slots, each slot having an opening with a center, each said center being oriented on a common line passing through said openings in said slots in a direction parallel to the length of the strip; and a single preformed metal connector piece having a longitudinally-oriented hook means for gripping one end of a roof tile, and a linear rod portion terminating in a linear stem portion means for insertion into one of said slots, said rod and stem portion means being of a combined length and type of material selected such that, when said stem portion means is inserted in a said slot and said hook means is gripping an end of a first roof tile, said stem portion means is manually bendable over the said slot and back upon itself by a single turn, and further such that, once bent back upon itself by said single turn, said stem portion means applies a retaining force of a magnitude selected for retaining said first roof tile in place without spontaneously unbending.

21. The fastening mechanism of claim 20 wherein said connector piece, when hooked to grip the end of said first roof tile, is shaped to extend through a hole in an underlying roof tile, and to apply a retaining force at two places: at a first end of said first roof tile via the hook means, and at said hole.

22. The fastening mechanism of claim 21 wherein said connector piece is fabricated of 0.090-inch-diameter wire.

23. The fastening mechanism of claim 22 wherein said wire is stainless steel.

24. A two-part roof tile fastening mechanism for fastening a plurality of roof tiles, said two-part roof tile fastening mechanism comprising:

a continuous metal strip having a length and a plurality of attachment slots, each slot having an opening therein, each slot being spaced apart along the length of the strip, each slot including an opening with a center, each said center being oriented on a common line passing through said openings in said slots in a direction parallel to the length of the strip;

a single preformed metal connector piece having a first hook for gripping one end of a first of said roof tiles, and a linear rod portion terminating in a linear stem portion for insertion into one of said slots, said rod portion and said stem portion being of a type of metal selected such that when said stem portion is inserted in a said slot and said first hook is gripping said one end of said first of said tiles, said stem portion is manually bendable over the said slot and back upon itself to form a second hook for supporting at least the weight of said first of said roof tiles so as to retain said first of said roof tiles in place on a roof;

and wherein the opening in each said slot is oriented such that a respective said straight stem portion is directly insertable through said opening by insertion along the length of the strip in a direction parallel to the length of the strip.

* * * * *